US007930781B1

(12) United States Patent
Dana, Jr. et al.

(10) Patent No.: US 7,930,781 B1
(45) Date of Patent: Apr. 26, 2011

(54) APPARATUS, SYSTEM AND METHOD FOR FACILITATING INFANT DEVELOPMENT

(76) Inventors: William H. Dana, Jr., San Francisco, CA (US); Lisa G. Dana, San Francisco, CA (US)

( * ) Notice: Subject to any disclaimer, the term of this patent is extended or adjusted under 35 U.S.C. 154(b) by 0 days.

(21) Appl. No.: 12/777,365

(22) Filed: May 11, 2010

Related U.S. Application Data

(60) Provisional application No. 61/291,477, filed on Dec. 31, 2009.

(51) Int. Cl.
*A47G 9/00* (2006.01)

(52) U.S. Cl. ..... 5/655; 5/731; 5/630

(58) Field of Classification Search ..... 5/655, 736, 5/731, 630, 632
See application file for complete search history.

(56) References Cited

U.S. PATENT DOCUMENTS 5,675,853 A * 10/1997 Linge ..... 5/655
7,712,169 B2 * 5/2010 Kovalyak ..... 5/655

* cited by examiner

*Primary Examiner* — Fredrick Conley
(74) *Attorney, Agent, or Firm* — Maier & Maier, PLLC

(57) ABSTRACT

According to at least one exemplary embodiment, a mat for facilitating infant development is disclosed. The mat may include a base portion, a support member, and at least one gripping member. The mat may include a texture pattern defined on the surfaces thereof. The mat may encourage development of the infant's cognitive abilities, tactile perception, fine motor skills and strengthening of the infant's core muscles.

7 Claims, 3 Drawing Sheets

APPARATUS, SYSTEM AND METHOD FOR FACILITATING INFANT DEVELOPMENT

RELATED APPLICATIONS

The present invention claims priority under 35 U.S.C. §120 to U.S. Provisional Patent Application No. 61/291,477, filed on Dec. 31, 2009, the disclosure of which is incorporated by reference herein in its entirety.

BACKGROUND

The first six months of an infant's life are an important time for the infant's development. To reach certain developmental stages, infants need to spend a sufficient amount of time in the prone (belly-down) position. The prone position helps the infant to improve his or her core strength and development by allowing the infant to develop strength to lift the head and to use his or her arms for support. Such activity helps achieve further developmental milestones such as rolling, sitting and crawling, which in turn lead to development in other areas. However, infants are increasingly spending more time in the supine (belly-up) position rather than the prone position due to fears of Sudden Infant Death Syndrome. There also exist devices that promote infant support in the supine position. The supine position, however, and devices that support the infant in the supine position, do not allow the infant to develop such core strength and motor skills to the same extent as the prone position.

SUMMARY

According to at least one exemplary embodiment, a mat for facilitating infant development is disclosed. The mat may include a base portion, a support member, and at least one gripping member. The mat may encourage development of the infant's cognitive abilities, tactile perception, fine motor skills and strengthening of the infant's core muscles.

BRIEF DESCRIPTION OF THE FIGURES

Advantages of embodiments of the present invention will be apparent from the following detailed description of the exemplary embodiments thereof, which description should be considered in conjunction with the accompanying drawings in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the terms "embodiments of the invention", "embodiment" or " "invention" do not require that all embodiments of the invention include the discussed feature, advantage or mode of operation.

Figure 1A:
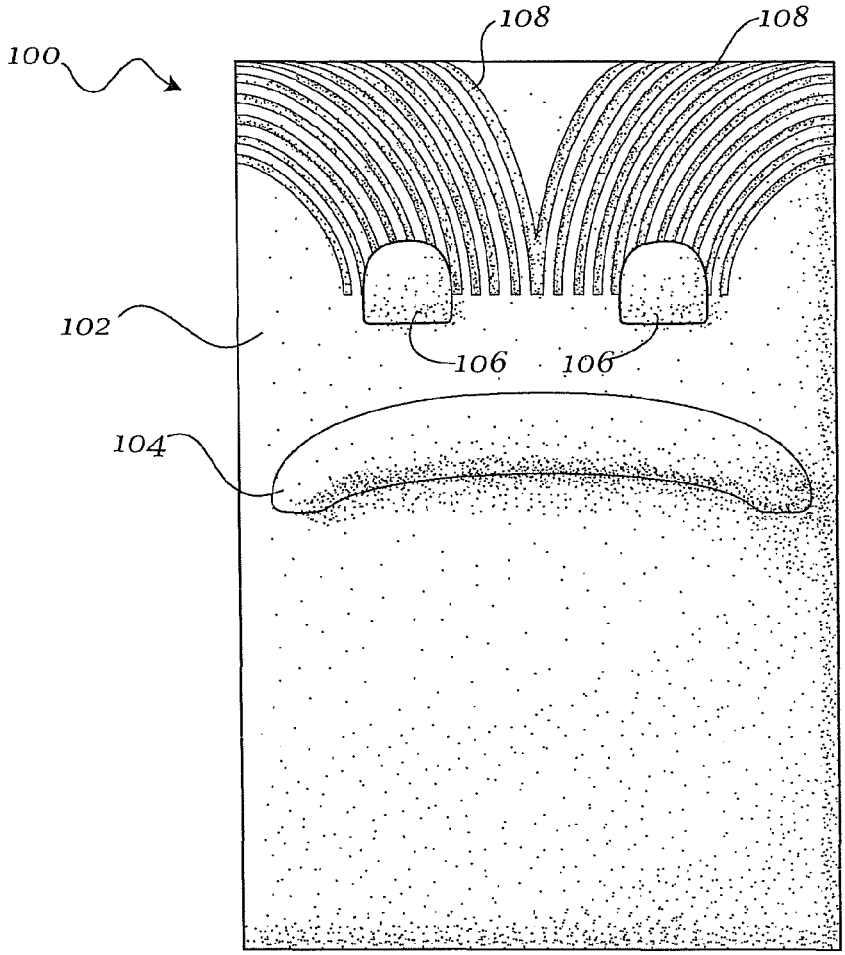
FIG. 1*a* is a top view of an exemplary embodiment of the present invention.
Figure 1B:
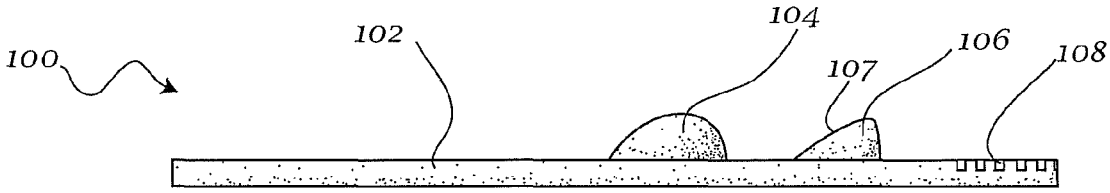
FIG. 1*b* is a side view of an exemplary embodiment of the present invention.
Figure 1C:
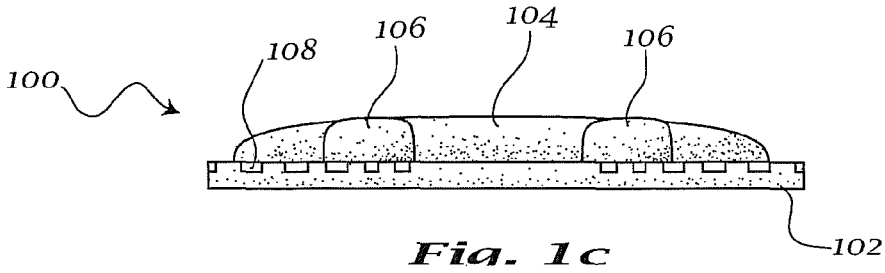
FIG. 1*c* is a front view of an exemplary embodiment of the present invention.

Generally referring to FIGS. 1*a*-1*c*, a mat 100 for facilitating infant development is disclosed. Mat 100 may be constructed of a durable, resilient, and easy to clean material having cushioning properties, such as, for example, foam polyvinyl chloride (foam PVC). Mat 100 may be formed from a single piece of such material. Mat 100 may further include a base portion 102, a support arch 104, raised pads 106, and a plurality of grooves 108 defined in the top surface of base portion 102. Base portion 102 may have a thickness sufficient to provide support and cushioning for an infant of approximately 0 to 6 months of age. The thickness of base portion 102 may also facilitate the folding or rolling of mat 100 for ease of storage and portability. Support arch 104 and pads 106 may be formed such that they are integral with mat 100. Base portion 102 may also have a flat surface and be adapted to diminish the likelihood of pooling or collection of fluids therein. Furthermore, base portion 102 may be adapted to provide a comfortable surface for resting the head of the infant.

Base portion 102, support arch 104 and raised pads 106 may incorporate a texture pattern defined in the surface thereof. The texture pattern may be one of a variety of texture patterns intended to stimulate the infant's tactile perception and fine motor skills. The texture pattern may also facilitate providing support and grip for the infant's limbs to aid the infant in adopting various positions on the mat, for example, to push his torso upwards through the use of his arms and hands, thereby strengthening the infant's core muscles. The texture pattern may also stimulate the infant's interest in the surfaces and shapes of mat 100, encouraging the infant to explore mat 100 with his hands, thereby stimulating cognitive development.

Support arch 104 may extend from approximately the left edge of mat 100 to approximately the right edge of mat 100 and may have a substantially arcuate or incurvate shape, as shown in FIG. 1. An infant may be positioned prone on mat 100 such that support arch 104 is located substantially under the upper torso of the infant, thereby providing a limited amount of support for the infant. The shape of and the support provided by support arch 104 may increase the infant's comfort level and thereby encourage the infant to maintain the prone position while on mat 100. However, support arch 104 may further be defined such that it does not provide support beyond what is necessary for the infant's comfort when the infant is in the prone position, and may encourage the infant to use his muscles to raise his torso above mat 100, thereby stimulating development of the infant's core muscles. Support arch 104 may further be adapted to provide diminishing support as the weight of the infant increases. For example, support arch may progressively compress or collapse in relation to increasing pressure applied to the top thereof. Consequently, by providing diminishing support as an infant grows, support arch 104 may encourage the growing infant to utilize more of his own strength, thereby stimulating further development of the infant's core and extremity muscles.

Raised pads 106 may be positioned on base portion 102 between the front edge of mat 100 and support arch 104. Raised pads 106 may have a rear face 107 positioned substantially diagonally with respect to the top surface of mat 100. The angle of rear face 107 with respect to the top surface of mat 100 may be such that it presents a comfortable surface which the infant may grip or on which the infant may place the palms of his hands and push himself away therefrom. The raised pads may thereby facilitate developing strength in the infant's core muscles and arms by providing a way for the infant to raise his torso above mat 100.

Mat 100 may also include a plurality of grooves 108 defined in the top surface of base portion 102. Grooves 108 may have a depth not exceeding the thickness of base portion 102. Grooves 108 may have a shape that encourages the infant to move his hands from the corners of base portion 102 towards his torso and towards raised pads 106. In one embodiment, each of grooves 108 may have a substantially arcuate shape. Each of grooves 108 may also have a first end located substantially near a front corner of base portion 102 and a second end located further toward the center of base portion 102, as shown in FIG. 1*a*.

Turning now to FIGS. 2*a*-2*d*, another embodiment of a mat 200 for facilitating infant development is disclosed. Mat 200 may be constructed of a durable, resilient, and easy to clean material having cushioning properties, such as, for example, foam polyvinyl chloride (foam PVC). Mat 200 may be formed from a single piece of such material. Mat 200 may further include a base portion 202, a support arch 204, and a plurality of undulations 206. Base portion 202 may have a thickness sufficient to provide support and cushioning for an infant of approximately 0 to 6 months of age. The thickness of base portion 202 may also facilitate the folding or rolling of mat 200 for ease of storage and portability. Support arch 204 may be formed such that it is integral with mat 200. Base portion 202 may also have a flat surface and be adapted to diminish the likelihood of pooling or collection of fluids therein. Furthermore, base portion 202 may be adapted to provide a comfortable surface for resting the head of the infant.

Figure 2A:
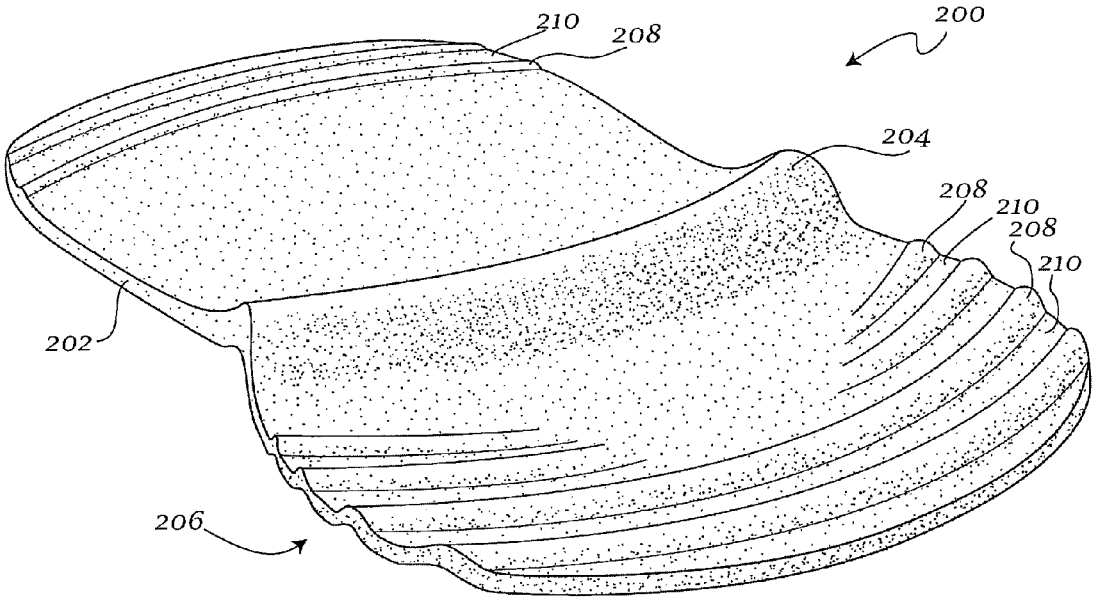
FIG. 2*a* is a front isometric view of another exemplary embodiment of the present invention.

The plurality of undulations 206 may be disposed between support arch 204 and the front edge of mat 200 and may also be disposed between support arch 204 and the rear edge of mat 200. The plurality of undulations 206 may be defined in the top surface of base portion 202, or may be defined by the undulation of the entire thickness base portion 202. The plurality of undulations 206 may further define a plurality of ridges 208 and a plurality of valleys 210 disposed therebetween. Each of ridges 208 and valleys 210 may have a substantially arcuate shape and may extend from the approximately the left edge of mat 200 to approximately the right edge of mat 200. In one embodiment, the elevation of ridges 208 and the depth of valleys 210 may vary as desired, or due to functional or aesthetic considerations; for example, each of the elevation of ridges 208 and the depth of valleys 210 may decrease with proximity to the center of mat 200, as shown in FIG. 2*a*. The center of mat 200 may have a flat surface and be adapted to diminish the likelihood of pooling or collection of fluids therein, and may also be adapted to provide a comfortable surface for resting the head of the infant.

Figure 2B:
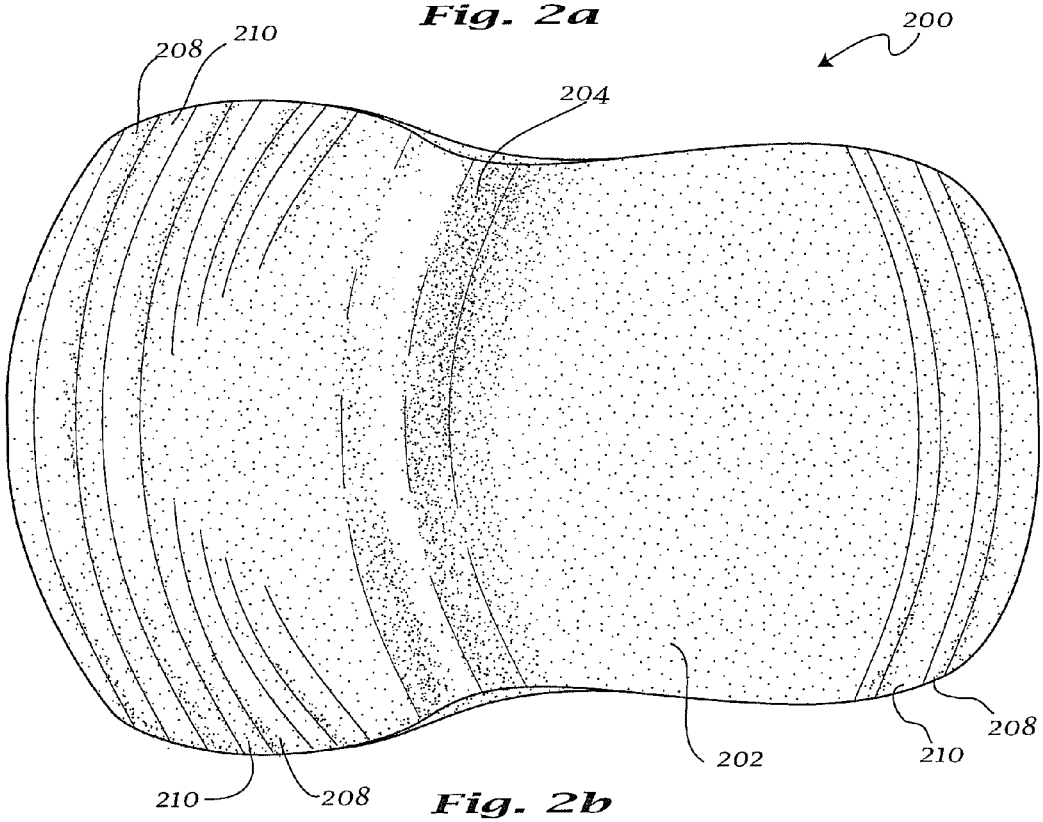
FIG. 2*b* is a top view of another exemplary embodiment of the present invention.
Figure 2C:
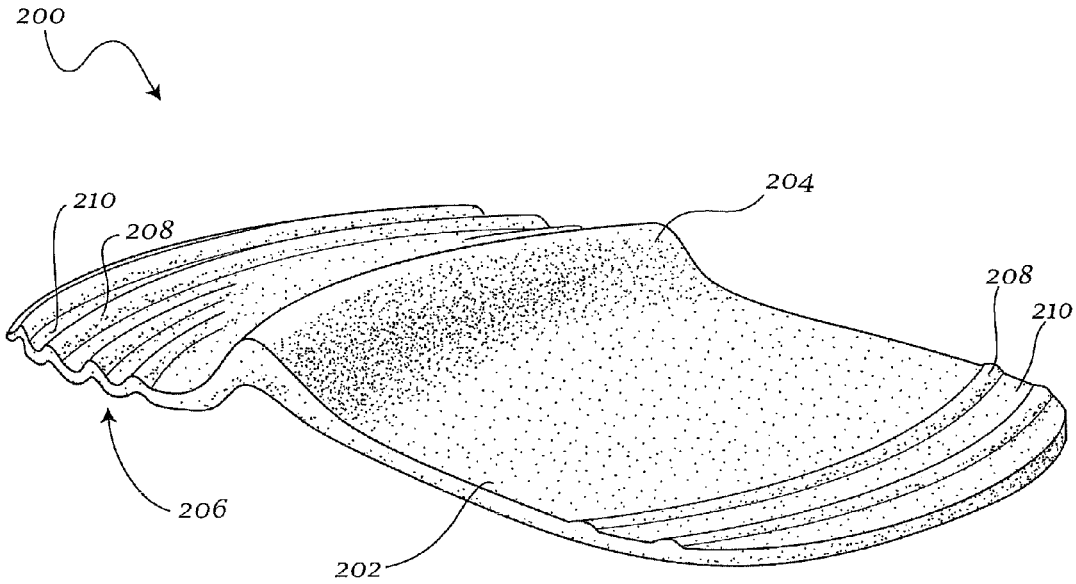
FIG. 2*c* is a rear isometric view of another exemplary embodiment of the present invention.
Figure 2D:
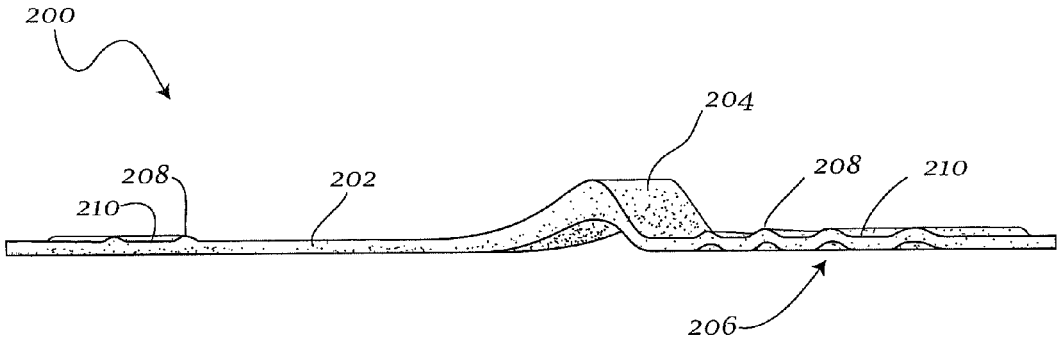
FIG. 2*d* is a side view of another exemplary embodiment of the present invention.

Support arch 204 may extend from approximately the left edge of mat 200 to approximately the right edge of mat 200 and may have a substantially arcuate or incurvate shape, as shown in FIG. 2*b*. When an infant is positioned prone on mat 200, support arch 204 may be located substantially under the upper torso of the infant, thereby providing a limited amount of support for the infant. The shape of and the support provided by support arch 204 may increase the infant's comfort level and thereby encourage the infant to maintain the prone position while on mat 200. However, support arch 204 may further be defined such that it does not provide support beyond what is necessary for the infant's comfort, and may encourage the infant to use his muscles to raise his torso above mat 200, thereby stimulating development of the infant's core muscles. Support arch 204 may further be adapted to provide diminishing support as the weight of the infant increases. For example, support arch may progressively compress or collapse in relation to increasing pressure applied to the top thereof. Consequently, by providing diminishing support as an infant grows, support arch 204 may encourage the growing infant to utilize more of his own strength, thereby stimulating further development of the infant's core and extremity muscles.

Base portion 202, support arch 204 and undulations 206 may incorporate a texture pattern defined in the surface thereof. The texture pattern may be one of a variety of texture patterns intended to stimulate the infant's tactile perception and fine motor skills. The texture pattern may also facilitate providing support and grip for the infant's limbs to aid the infant in adopting various positions on the mat, for example, to push his torso upwards via the use of his arms and hands, thereby strengthening the infant's core muscles. The texture pattern may also stimulate the infant's interest in the surfaces and shapes of mat 200, encouraging the infant to explore mat 200 with his hands, thereby stimulating cognitive development.

Ridges 208 and valleys 210 may be disposed between the support arch 204 and the front edge of base portion 202. The layout of ridges 208 and valleys 210 may further be configured to present a comfortable surface relief for the infant to grip or on which the infant may place his hands and push away therefrom. Ridges 208 and valleys 210 may thereby facilitate developing strength in the infant's core muscles and arms by providing a way for the infant to raise his torso above mat 200. Furthermore, the layout of ridges 208 and valleys 210 may stimulate the infant's interest therein, encouraging the infant to explore ridges 208 and valleys 210 with his hands and thereby stimulating the infant's cognitive development.

Ridges 208 and valleys 210 may also be disposed between the support arch 204 and the rear edge of base portion 202. The layout of ridges 208 and valleys 210 may further be configured to present a comfortable surface relief for the infant on which the infant may place his feet and push away therefrom. Ridges 208 and valleys 210 may thereby facilitate developing strength in the infant's core muscles and legs by providing a way for the infant to raise his torso above mat 200.

The foregoing description and accompanying drawings illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A mat for facilitating infant development, comprising:

a base portion sized to accept an infant;

a supporting member having a substantially arcuate shape integrally formed with the base portion, the supporting member disposed substantially between the front edge of the base portion and the midsection of the base portion, wherein the supporting member is raised with respect to the base portion and sized and the upper torso of an infant; and at least one raised gripping member disposed on the base portion between the supporting and the front edge of the base portion, the at least one gripping member having a face positioned at an angle to a top surface of the base portion, wherein the gripping member is configured to facilitate aiding the infant in raising his torso above the mat.

2. The mat of claim 1, wherein the gripping member is configured to stimulate the infant's motor perception.

3. The mat of claim 1, further comprising a texture pattern defined in the surface thereof.

4. The mat of claim 1, wherein at least one gripping member is disposed between the supporting member and the rear edge of the base portion.

5. The mat of claim 1, wherein the supporting member is adapted to provide diminishing support for the upper torso of an infant in relation to an increase in weight of the infant.

6. The mat of claim 1, wherein the at least one gripping member is a plurality of ridges defined in the base portion.

7. The mat of claim 1, wherein the at least one gripping member is a plurality of grooves defined in the base portion.

* * * * *

UNITED STATES PATENT AND TRADEMARK OFFICE

CERTIFICATE OF CORRECTION

PATENT NO. : 7,930,781 B1
APPLICATION NO. : 12/777365
DATED : April 26, 2011
INVENTOR(S) : Dana et al.

It is certified that error appears in the above-identified patent and that said Letters Patent is hereby corrected as shown below:

Column 5, line 4, "respect to the base portion and sized and the upper torso" should be changed to "respect to the base portion and sized and positioned to support the upper torso".

Column 5, line 7, "portion between the supporting and the front edge of the" should be changed to "portion between the supporting member and the front edge of the".

Signed and Sealed this
Twenty-sixth Day of July, 2011

David J. Kappos

David J. Kappos
*Director of the United States Patent and Trademark Office*